United States Patent [19]

Hwang

[11] Patent Number: 4,550,229

[45] Date of Patent: Oct. 29, 1985

[54] TRUMPET HORN SPEAKER

[76] Inventor: Shih M. Hwang, P.O. Box 7-369, Taipei, 106, Taiwan

[21] Appl. No.: 427,813

[22] Filed: Sep. 29, 1982

[51] Int. Cl.[4] ..... H04K 9/06

[52] U.S. Cl. ..... 179/115.5 H; 179/115.5 R; 181/179

[58] Field of Search ..... 179/115.5 H, 115.5 R, 179/115.5 K; 181/159, 179, 180, 185; 381/75; 367/176

[56] References Cited

U.S. PATENT DOCUMENTS

| | | | |
|---|---|---|---|
| 3,454,729 | 7/1969 | Seebinger | 179/115.5 H |
| 3,617,654 | 11/1971 | Heidrich | 179/115.5 R |
| 3,989,909 | 11/1976 | Hodsdon et al. | 179/184 |
| 3,991,286 | 11/1976 | Henricksen | 179/115.5 H |
| 4,034,165 | 7/1977 | Haeder | 179/115.5 R |
| 4,138,593 | 2/1979 | Hasselbach et al. | 179/146 E |
| 4,205,205 | 5/1980 | Babb | 179/115.5 R |

FOREIGN PATENT DOCUMENTS

| | | | |
|---|---|---|---|
| 53-121613 | 10/1978 | Japan | 179/115.5 R |
| 848431 | 9/1960 | United Kingdom | 179/115 H |

*Primary Examiner*—Gene Z. Rubinson
*Assistant Examiner*—Danita R. Byrd
*Attorney, Agent, or Firm*—Cushman, Darby & Cushman

[57] ABSTRACT

This speaker represents an improved trumpet horn speaker structure. A trumpet horn speaker is disclosed having a metallic heat sink, a lower magnetic pole mounted on the heat sink, a round permanent magnet mounted on the heat sink, an upper magnetic mounted on the heat sink, a damping bracket mounted on the heat sink, a plastic housing integrally mounted to the heat sink so that the upper magnetic pole, the lower magnetic pole and the round permanent magnet are thereby tightly secured to the plastic housing, the plastic housing providing a good waterproofing for the trumpet horn speaker and the metallic heat sink providing protection against over heating for the voice coil of the trumpet horn speaker.

2 Claims, 4 Drawing Figures

TRUMPET HORN SPEAKER

BACKGROUND OF THE INVENTION

The present invention relates to an improved trumpet horn speaker.

Unlike conventional speakers, trumpet horn speakers, which are frequently used outdoors, must be waterproof and therefore must utilize a plastic or metallic housing. However, the plastic or metallic housing used on conventional speakers is only partially waterproof and does not provide a good heat sink for the upper and lower magnetic poles and the round permanent magnet inside, so that during long-periods of continuous operation or an operation that involves high output power, the upper and lower magnetic poles, the round permanent magnet and the voice coil will undergo thermal expansion due to poor heat dissipation. This results in a short or open circuit, deformation and distortion of the voice coil.

A metallic housing does not allow heat from the upper and lower magnetic poles and the round permanent magnet to be easily dissipated and the metallic housing itself does not provide an ideal waterproof feature. Furthermore, as the lower and upper magnetic poles and the round permanent magnet are secured with adhesives, they usually become loosened either because they are not secured tightly enough or the adhesives fall off.

The trumpet horn speaker of the present invention is designed to correct the above faults.

SUMMARY OF THE INVENTION

The present speaker presents an improved trumpet horn speaker. The improved trumpet horn speaker comprises a lower magnetic pole, a round permanent magnet, an upper magnetic pole, a damping bracket and a plastic seat secured to a metallic heat sink all of which are in turn fixed to a one-piece moulded plastic housing. This arrangement allows the bracket that holds the upper magnetic pole, the round permanent magnet and the lower magnetic pole to be tightly secured to the plastic housing, thereby preventing the components from being loosened from the housing or broken by excessive force exerted on the speaker. In this structural combination heat from both the upper and lower magnetic poles plus the round permanent magnet is dissipated through the metallic heat sink so that the voice coil will not be damaged by either a short or open circuit or deformation and/or distortion due to thermal expansion resulting from excessive heat. The one-piece moulded plastic housing is effective in protecting the speaker from moisture.

DETAILED DESCRIPTION OF THE INVENTION

The trumpet horn speaker of the present invention has a heat sink bracket that holds the upper and lower magnetic poles the round permanent magnet, the damping bracket and the plastic seat with adhesives and screws. The heat sink is mounted to the plastic housing so that the heat sink tightly contacts the plastic seat. Due to matching, i.e. correspondingly engageable, structures, the heat sink and plastic protect both the upper and lower magnetic poles plus the round permanent magnet from external forces so they will not become loosened or broken.

The heat sink bracket and heat sink also allow the heat produced by the alternating magnetic field when an audio signal passes through the voice coil to be dissipated into air to thereby maintain the interior speaker temperature between 60° C. and 70° C. This prevents a short or open circuit, deformation and distortion of the voice coil resulting from thermal expansion of the voice coil, the upper and lower magnetic poles, and/or the round permanent magnet due to excessive accumulation of heat.

Figure 1:
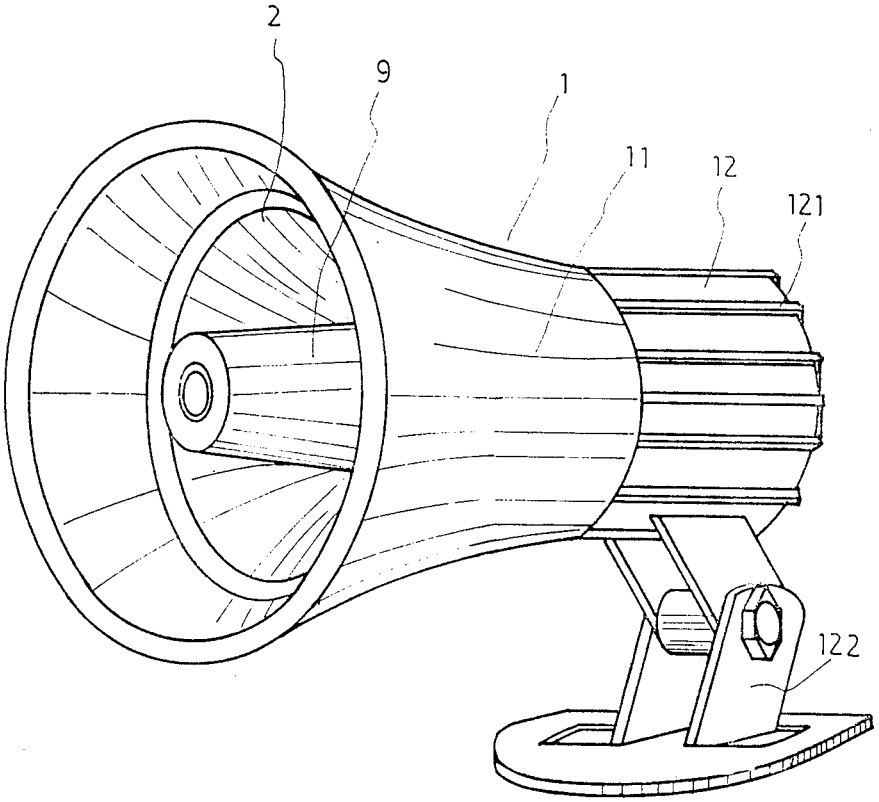
FIG. 1 is an outer view of the present invention 1.

An embodiment of the invention is described as follows referring now to FIGS. 1 to 4:

In FIG. 1, the plastic housing 1 is a hollow one-piece moulded structure. The front 11 takes the shape of a trumpet extending outwards, and the rear section 12, which is the back compartment of the speaker, is decorated with streamlines 121 which also function as heat-sink cooling fins. The rear section 12 has a mounting bracket 122 thereon for mounting the complete speaker to another object. A hole 123 (see FIG. 2) is provided in the center of the rear end of the plastic housing 1 through which a mounting screw 10 is inserted to secure the components of the speaker, with each other.

Figure 2:
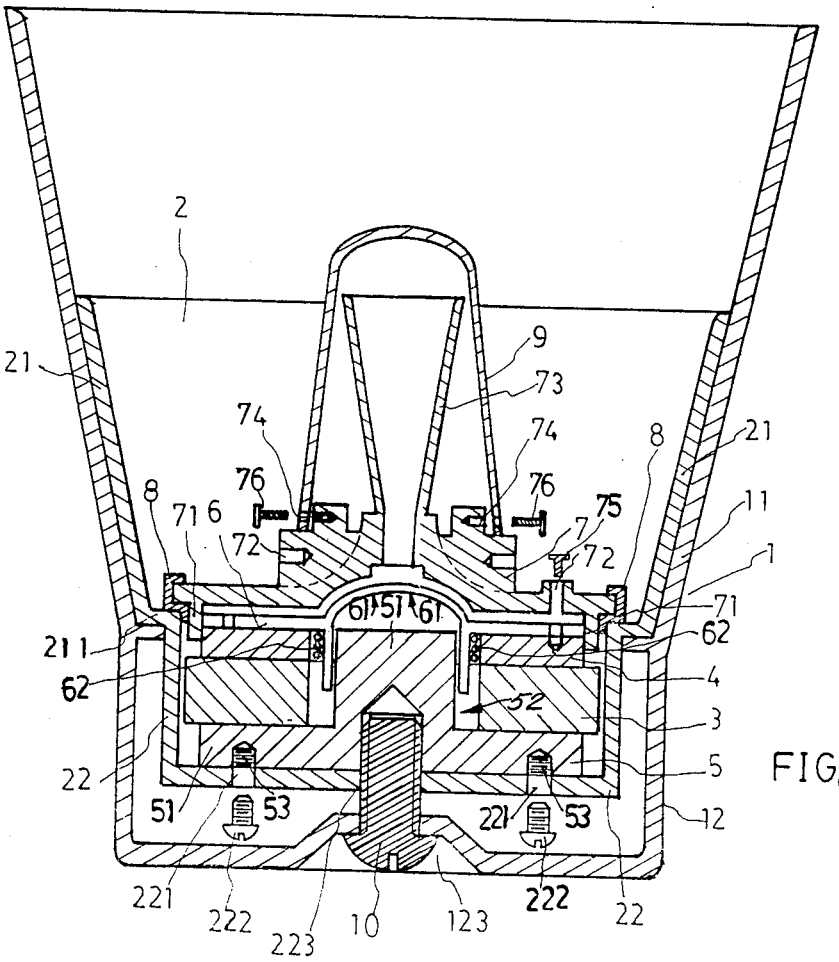
FIG. 2 shows the interior structure of the present invention 1.

In FIG. 2, showing interior speaker structure, at the interior front 11 of the plastic housing 1, there is a metallic heat sink 2. The heat sink 2 takes the shape of a trumpet and is tightly fitted into the hollow portion of the rear section 11.

The round permanent magnetic 3 is of annular structure, above which is the annular upper magnetic pole 4 and below which is the round projecting lower magnetic pole 5. When fitted together, the magnetic flux lines of the round permanent magnetic 3 are concentrated in the gap 52 between the projecting cylinder 51 of the lower magnetic pole 5, the upper magnetic pole 4 and the round permanent magnet 3. The diaphragm 61 and the voice coil 62 are located on and mounted on damping bracket 6. The damping bracket 6 is so fitted on the upper magnetic pole 4 that the voice coil is set in the gap 52 formed by the cylinder 51 of the lower magnetic pole 5, the upper magnetic pole 4 and the round permanent magnetic 5.

The plastic seat 7 above the damping bracket 6 is a stepwise structure with a lug 71 at its lower end to fit on the base 211 at the front 21 of the metallic heat sink 2 so that the lower magnetic pole 5, the round permanent magnet 3, the upper magnetic pole 4 and the damping bracket 6 are secured to the interior base 12 of the metallic heat sink 2 through the plastic seat 7. The speaker has a rubber ring 8 arranged around the plastic seat 7. The ring 8 provides for stronger adhesion of the plastic seat 8. A hole 72 is provided in the plastic seat 7. Screws thread through hole 72 to fix the plastic seat to the damping bracket 6. Hole 72 is designed to be moisture-proof, i.e., moisture will not seep through hole 72.

The upper magnetic pole 4, the round permanent magnet 3, and the lower magnetic pole 5 are fixed together with adhesives to thereby integrally connect the plastic seat 7 and the damping bracket into a one-piece structure. A small lug 75 fits into screw hole 72, provided on the plastic seat 7 to secure plastic seat to the upper magnetic pole 4.

The sound tube 73 is a one-piece extension of the plastic seat 7 and allows the audio signal produced by the diaphragm 61 to be transmitted to cause a resonance of the speaker jacket 9 so that the audio signal may be amplified as it is being transmitted into space. The speaker jacket 9 is fixed by a screw to the screw hole 74.

The metallic heat sink 2 takes the shape of a trumpet and has a screw hole 221 at its base through which the block composing the lower and upper magnetic poles and the round permanent magnet is secured to the hole 53 on the lower magnetic pole by a screw 222. The metallic heat sink 2 is made of metallic materials with good thermal conductivity, which allows heat from the upper magnetic pole 4, the lower magnetic pole 5 and the round permanent magnet 3 to be dissipated into the air, so as to maintain the temperature inside from 60° C. to 70° C. and thereby prevent excessive thermal expansion of the components.

A screw hole 223 is provided at the center of the rear 22 of the metallic heat sink 2, so that the assembled metallic heat sink 2 may be securely attached to the plastic housing 1 and the upper magnetic pole 4, the lower magnetic pole 5 and the round permanent magnet 3 may be adequately protected from being loosened or broken as they are pressed during the screwing process, thereby providing a high quality product.

The screw hole 223 is provided at the center of the rear end 22 of the metallic heat sink 2 allows the assembled metallic heat sink to be secured to the plastic housing 1 so that, once locked by screws 10, the front 21 and rear ends 22 of the metallic heat sink 2 are tightly fitted to the front 11 and rear ends 12 of the plastic housing 1.

The present invention overcomes drawbacks of conventional trumpet speakers. Some drawbacks are attributable to the adhesives used to adhere the upper magnetic pole 4, the lower magnetic pole (5), and the round permanent magnet 3. The adhesives do not do the job and the parts come unglued.

The present invention also features a metallic heat sink which serves to prevent the upper and lower magnetic poles and the round permanent magnet from falling apart under pressure, thereby providing a high quality product. It further acts as an ideal heat sink for the voice coil, the upper magnetic pole 4, the lower magnetic pole 5 and the round permanent magnet 3 so as to prevent thermal expansion which would cause the voice coil to deform, become a short or open circuit or become distorted. The plastic housing is a one-piece moulded structure whose waterproof material does not fade in color or deteriorate in quality.

Figure 3:
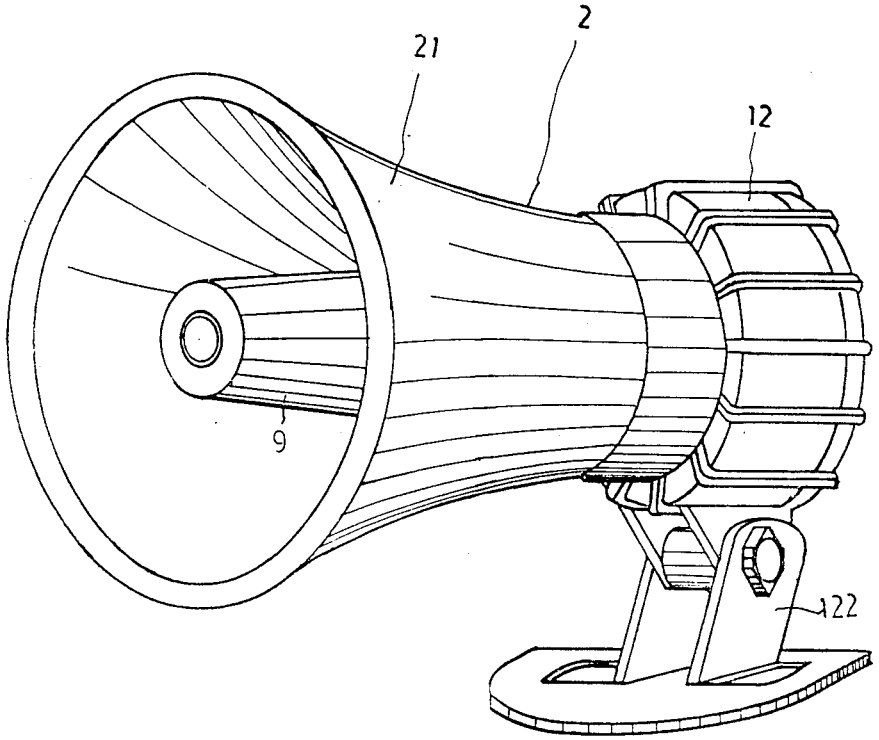
FIG. 3 is an outer view of the present invention 2.
Figure 4:
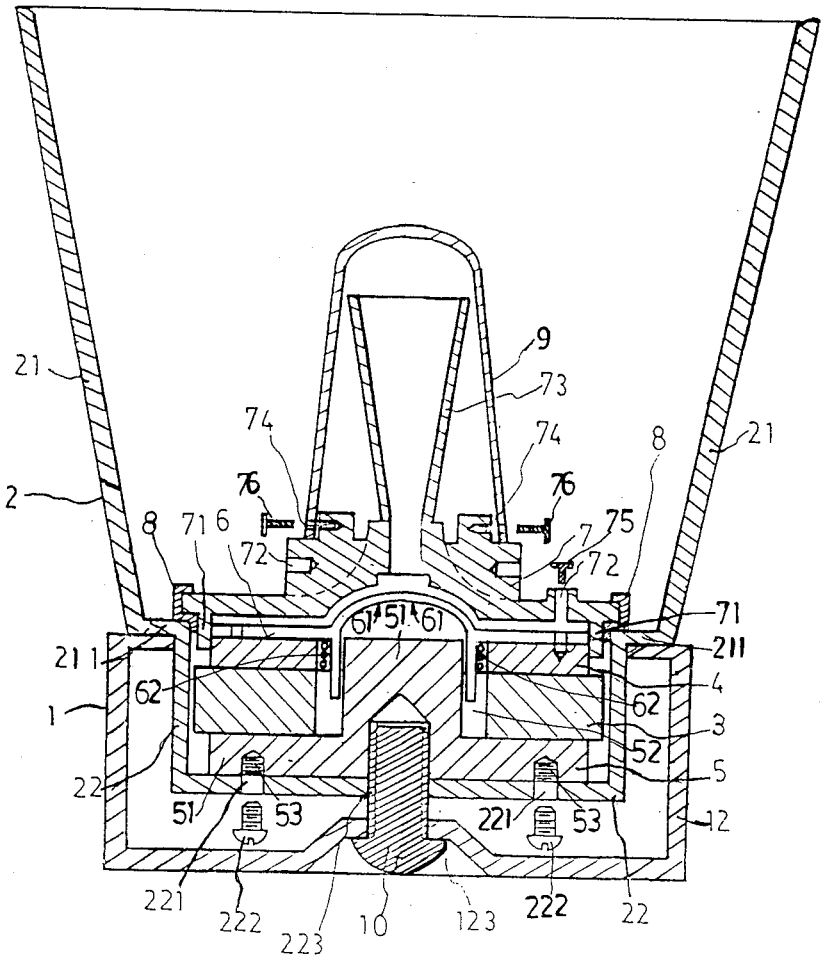
FIG. 4 shows the interior structure of the present invention 2.

The metallic heat sink 2 of this invention can be made in any convenient shape so as to fit plastic housings with different interior structures. FIG. 3 is another outer view of the present invention. FIG. 4 shows another interior structure of the present invention.

The interior structure shown in FIG. 4 is roughly the same as that depicted in FIG. 2 with the only primary difference being the metallic heat sink 2 which outwardly extends its front 21 and is made through a special one-piece process as shown in FIG. 3. In FIG. 1, the plastic housing 1 is fixed only at its rear end 12 by a screw 10 to the rear end 22 of the metallic heat sink 2. Heat is effectively dissipated through the metallic heat sink which has a large surface area and the structure also provides an ideal waterproof facility.

The metallic heat sink and the plastic housing in the present invention are fitted together as shown in FIGS. 1 and 3.

I claim:

1. A trumpet horn speaker comprising:

a metallic heat sink, a lower magnetic pole mounted on said heat sink, a round permanent magnet connected to said lower magnetic pole, an upper magnetic pole connected to said round permanent magnet, a damping bracket mounted on said heat sink, a plastic housing mounted on said heat sink;

whereby said plastic housing provides good waterproofing for said trumpet horn speaker and said metallic heat sink provides protection against overheating of the voice coil of said trumpet horn speaker.

2. A trumpet horn speaker comprising:

a metallic heat sink having a base with an interior surface and an exterior surface, a lower magnetic pole mounted on said interior surface, a lower round permanent magnet mounted on said lower magnetic pole, an upper magnetic pole mounted on said lower round permanent magnetic pole, a damping bracket mounted on said upper magnetic pole, a seat connected to said damping bracket, means for sealing said seat to said damping bracket and said heat sink, a housing attached to said exterior surface of said heat sink, and said housing providing good waterproofing of said trumpet horn speaker and said metallic heat sink providing protection for the voice coil of said trumpet horn speaker.

* * * * *